United States Patent [19]

Uchida

[11] 4,139,158

[45] Feb. 13, 1979

[54] FUEL DISCHARGE NOZZLE

[75] Inventor: Kazuo Uchida, Higashimatsuyama, Japan

[73] Assignee: Diesel Kiki Co., Ltd., Tokyo, Japan

[21] Appl. No.: 880,409

[22] Filed: Feb. 23, 1978

Related U.S. Application Data

[63] Continuation of Ser. No. 718,245, Aug. 27, 1976, abandoned.

[30] Foreign Application Priority Data

Sep. 1, 1975 [JP] Japan ..... 50/104978

[51] Int. Cl.[2] ..... B05B 1/14

[52] U.S. Cl. ..... 239/533.12; 239/559; 239/567

[58] Field of Search ..... 239/533.2, 533.12, 557, 239/559, 561, 562, 567

[56] References Cited

U.S. PATENT DOCUMENTS 3,442,451 5/1969 Nagel ..... 239/533.5 X

FOREIGN PATENT DOCUMENTS 17486 8/1966 Japan ..... 239/567

*Primary Examiner*—John J. Love

*Attorney, Agent, or Firm*—Frank J. Jordan

[57] ABSTRACT

A nozzle body is formed with a fuel discharge chamber. A discharge valve opens into the chamber at one end and discharge orifices open from the chamber at the other end at various angles. The axial distances between the orifices and the valve are selected in accordance with the angles in such a manner that the fuel flow paths from the valves to the respective orifices have the same curvature and equal amounts of fuel are discharged through the orifices.

1 Claim, 2 Drawing Figures

FUEL DISCHARGE NOZZLE

This is a continuation of application Ser. No. 718,245, filed Aug. 27, 1976, now abandoned.

BACKGROUND OF THE INVENTION

The present invention relates to an improved fuel discharge nozzle which is ideally suited for use as a fuel injection nozzle in an automotive vehicle.

The type of fuel discharge nozzle to which the present invention constitutes a substantial improvement generally comprises a nozzle body. A plurality of fuel discharge orifices open from the tip of the nozzle body at different angles to provide a dispersed fuel spray. In all nozzles of this type available heretofore, however, the fuel discharge rates through the various orifices are unequal in dependence on the angles of the orifices. Specifically, the greater the angle the lower the discharge rate. Attempts to compensate for this phenomenon by varying the diameters of the orifices have only compounded the problem. The effects of such uneven spray characteristics are extremely detrimental where the nozzle is provided to inject fuel into an internal combustion engine, with the irregularity increasing as the fuel discharge rate decreases.

It is therefore an object of the present invention to provide a fuel discharge nozzle having a plurality of fuel discharge orifices opening from a nozzle body at different angles in which equal amounts of fuel are discharged through all of the orifices.

It is another object of the present invention to provide a fuel discharge nozzle comprising a nozzle body defining therein a fuel discharge chamber, a discharge valve opening into the chamber and a plurality of fuel discharge orifices opening from the chamber at different angles, the fuel flow paths from the valve to the respective orifices having the same curvature.

It is another object of the present invention to provide a fuel discharge nozzle comprising a nozzle body difining therein a fuel discharge chamber, a discharge valve opening into the chamber and a plurality of fuel discharge orifices opening from the chamber at different angles, axial distances from the valve to the orifices increasing as the angles increase.

It is another object of the present invention to provide a fuel discharge nozzle comprising a nozzle body defining therein a fuel discharge chamber, a discharge valve opening into the chamber and a plurality of fuel discharge orifices opening from the chamber and having axes which intersect an axis of the chamber at different angles, points of intersection of the axes of the orifices with the axis of the chamber being spaced from the valve by distances which increase with the angles.

It is another object of the present invention to provide a generally improved fuel discharge nozzle.

Other objects, together with the foregoing, are attained in the embodiment described in the following description and illustrated in the accompanying drawings.

DESCRIPTION OF THE PREFERRED EMBODIMENT

While the fuel discharge nozzle of the invention is susceptible of numerous physical embodiments, depending upon the environment and requirements of use, substantial numbers of the herein shown and described embodiment have been made, tested and used, and all have performed in an eminently satisfactory manner.

Figure 1:
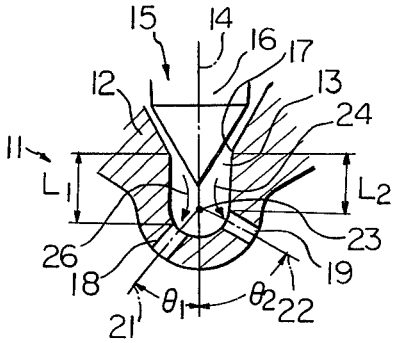
Fig. 1 PRIOR ART
FIG. 1 is a fragmentary sectional view of a prior art fuel discharge nozzle.

Referring now to FIG. 1 of the drawing, a prior art fuel discharge nozzle is generally designated as 11 and comprises a nozzle body 12 which defines therein a fuel discharge chamber 13. The nozzle body 12 has an axis 14 which is also considered as the axis of the discharge chamber 13. A fuel discharge control valve 15 comprises a needle valve element 16 which is engagable with a needle valve seat 17 to control fuel flow into the chamber 13 from a fuel source (not shown). First and second fuel discharge orifices 18 and 19 respectively open from the chamber 13 into, for example, a cylinder of an internal combustion engine (not shown). Although more than two orifices may open from the chamber 13, only two are shown for simplicity of illustration and serve to explain the principle of the present invention. In addition, the other parts of the discharge nozzle 11, such as a fuel passageway leading to the valve 15, are not the subject matter of the invention and are not shown.

The orifices 18 and 19 open from the chamber 13 along axes 21 and 22 respectively which intersect the axis 14 of the chamber 13 at a common point 23. In order to provide a dispersed spray from the nozzle 11, an angle $\theta 2$ between the axis 22 of the orifice 19 and the axis 14 is made greater than an angle $\theta 1$ between the axis 21 of the orifice 18 and the axis 14. By simple geometry, it is clear that an axial distance L2 between the orifice 19 and the valve seat 17 must be less than an axial distance L1 between the orifice 18 and the valve seat 17. As a consequence, a fuel flow path or streamline 24 leading from the valve 15 to the orifice 19 is move curved than a fuel flow path or streamline 26 leading from the valve 15 to the orifice 18. The greater curvature of the streamline 24 means that the flow resistance along the streamline 24 is also greater, and as a natural consequence less fuel is discharged through the orifice 19 than through the orifice 18.

A fuel discharge nozzle 31 embodying the present invention is designed to overcome the drawback of the nozzle 11 and provide equal fuel discharge through all discharge orifices regardless of the discharge angles. The nozzle 31 comprises a nozzle body 32 which defines therein a fuel discharge chamber 33. As with the nozzle 11, the nozzle 31 has an axis 34 which is also considered as the axis of the discharge chamber 33. A fuel discharge control valve 35 comprises a needle valve element 36 which is engagable with a needle valve seat 37 to control fuel flow from a fuel source (not shown) into the chamber 33. First and second fuel discharge orifices 38 and 39 respectively open from the chamber 33 along axes 41 and 42 which intersect the axis 34 of the chamber 33 at different points 43 and 44 respectively. An angle $\theta 4$ between the axis 42 of the orifice 39 and the axis 34 of the chamber 33 is greater than an angle $\theta 3$ between the axis 41 of the orifice 38 and the axis 34. In accordance with the principle of the invention, a distance L4 between the valve seat 37 and the orifice 39 is greater than a distance L3 between the valve seat 37 and the orifice 38. Fuel flow paths from the valve 35 to the orifices 38 and 39 are designated as 46 and 47 respectively.

The prior art nozzle 11 is designed in such a manner that the axes of all of the orifices intersect at the common point 23, thus establishing the geometical criterion that the axial distances from the valve 15 to the orifices decrease as the angles between the orifices and the axis 14 of the chamber 13 increase. As discussed above, this is the direct cause of unequal fuel discharge through the orifices.

This problem is overcome in the nozzle 31, in which the axial distances between the orifices and the valve 35 increase as the angle increase to make the streamlines from the valve 35 to the respective orifices equal in curvature and thereby provide equal fuel discharge through all of the orifices. As specifically illustrated in FIG. 2, the orifice 39 is oriented at a greater angle to the axis 34 than the orifice 38, $\theta 4$ being greater than $\theta 3$, and the distance L4 between the orifice 39 and the valve seat 37 is greater than distance L3 between the orifice 38 and the valve seat 37. The distances L4 and L3 are determined mathematically or empirically as functions of the angles $\theta 3$ and $\theta 4$ in such a manner that the streamlines 46 and 47 have the same curvature. It is a geometrical consequence that the point 44 of intersection between the axis 42 of the orifice 39 and the axis 34 is spaced farther from the valve 35 than the point 43 of intersection of the axis 41 of the orifice 38 and the axis 34. Although only two orifices are shown and described, the principle of the invention directly applies to a nozzle having more than two orifices.

In summary, it will be seen that the problem of uneven fuel discharge through orifices oriented at different angles is overcome by axially spacing the orifices in such a manner that the fuel flow streamlines leading thereto have equal curvature. Modifications within the scope of the invention will be possible for those skilled in the art after receiving the teachings of the present disclosure.

What is claimed is:

1. A fuel discharge nozzle comprising:

a nozzle body defining a fuel discharge chamber therein;

a fuel discharge control valve opening into the chamber for controlling flow of fuel thereinto;

the nozzle body being formed with pairs of diametrically opposed fuel discharge orifices opening from the chamber with each orifice of a pair being spaced from the valve along an axis of the chamber, each of the orifices being circumferentially spaced from one another about the axis of the chamber, the orifices opening from the chamber and each orifice of a pair having axes which intersect the axis of the chamber at different angles respectively, points of intersection of the axes of each orifice of a pair of the orifices with the axis of the chamber being spaced from the valve by distances which increase with the angles, axial distances of each orifice of a pair of the orifices from the valve being such that the fuel flows from the valve through the chamber to each orifice of a pair of the orifices along respective fuel flow paths of substantially equal curvature, whereby equal amounts of fuel are discharged through each orifice of a pair of the orifices.

* * * * *

UNITED STATES PATENT AND TRADEMARK OFFICE

CERTIFICATE OF CORRECTION

PATENT NO. : 4,139,158

DATED : February 13, 1979

INVENTOR(S) : Kazuo UCHIDA

Figure 2:
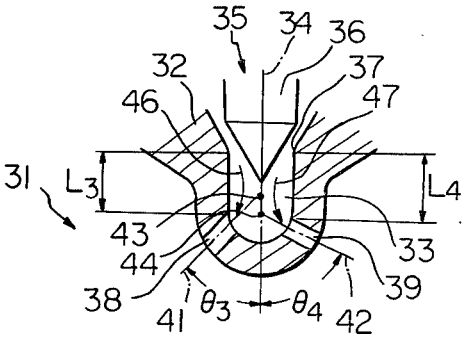
FIG. 2 is a fragmentary sectional view of a fuel discharge nozzle embodying the present invention.
Figure 3:
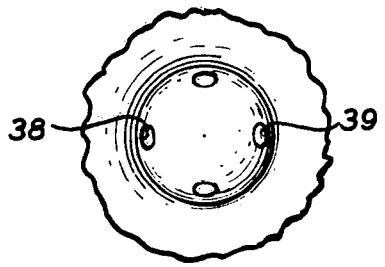

It is certified that error appears in the above-identified patent and that said Letters Patent are hereby corrected as shown below:

At the bottom of column 1 add the following paragraph:

--Figure 3 is a bottom view of Figure 2.--

Signed and Sealed this

*Fifth* Day of *June 1979*

[SEAL]

*Attest:*

RUTH C. MASON
*Attesting Officer*

DONALD W. BANNER
*Commissioner of Patents and Trademarks*